United States Patent [19]

Reader et al.

[11] Patent Number: 4,669,287

[45] Date of Patent: Jun. 2, 1987

[54] RUPTURABLE LOCK ASSEMBLY

[75] Inventors: Michael W. Reader, Danbury; John M. Charles, Hadleigh, both of United Kingdom

[73] Assignee: Ford Motor Company, Dearborn, Mich.

[21] Appl. No.: 781,362

[22] Filed: Sep. 30, 1985

[30] Foreign Application Priority Data

Oct. 4, 1984 [GB] United Kingdom ..... 8425091

[51] Int. Cl.[4] ..... E05B 15/16

[52] U.S. Cl. ..... 70/360; 70/1.5; 70/422; 292/DIG. 37; 292/DIG. 38

[58] Field of Search ..... 70/422, 1.5, 416, 360, 70/361, 379 R, 379 A, 380, DIG. 67, DIG. 73; 292/DIG. 37, DIG. 38, DIG. 24, DIG. 51, DIG. 52, 336.3

[56] References Cited

U.S. PATENT DOCUMENTS

| | | | |
|---|---|---|---|
| 1,324,428 | 12/1919 | Mair | 292/DIG. 37 X |
| 2,000,280 | 5/1935 | Fitzgerald | 70/1.5 |
| 2,004,434 | 6/1935 | Fitzgerald | 70/1.5 |
| 2,609,679 | 9/1952 | Bremer et al. | 70/422 |
| 2,787,154 | 4/1957 | Wesberry | 70/422 |
| 3,597,949 | 8/1971 | Nigrelli | 70/422 |
| 4,074,547 | 2/1978 | Seidewand | 70/422 X |
| 4,074,548 | 2/1978 | Milton | 70/422 X |
| 4,446,709 | 5/1984 | Steinbach | 70/422 X |

FOREIGN PATENT DOCUMENTS

| | | | |
|---|---|---|---|
| 537756 | 3/1957 | Canada | 292/DIG. 38 |
| 2748408 | 5/1979 | Fed. Rep. of Germany | 70/422 |

*Primary Examiner*—Robert L. Wolfe
*Assistant Examiner*—Lloyd A. Gall
*Attorney, Agent, or Firm*—Daniel M. Stock; Clifford L. Sadler

[57] ABSTRACT

A lock assembly has a lock barrel which slides in a housing so that a finger at the end of the barrel can release a latch. The lock barrel is prevented from sliding when the barrel is locked, by engagement of the finger with a blocking plate, but the barrel is freed when the key is inserted and turned. The finger is made so that it shortens if excessive axial force is applied while the barrel is locked. This shortening may be effected by including an easily rupturable connection between different sections of the finger. When the finger shortens, the connection ruptures and prevents the finger from getting near the latch to release it. Once the connection has ruptured, further movement of the barrel into the housing will bring the barrel into contact with the outer periphery of the blocking plate which is well supported.

14 Claims, 5 Drawing Figures

RUPTURABLE LOCK ASSEMBLY

BACKGROUND OF THE INVENTION

This invention relates to a lock assembly wherein the lock protects a push button operated latch mechanism so that the latch mechanism can only be released when the lock is unlocked.

Motor vehicles often have their doors or tailgates closed by a latch mechanism which is operated by pushing a button. When the door is locked, the button either cannot be pushed, or when pushed does not release the latch.

Such locks are vulnerable to hammer blows along the axis of the push-button which can force the lock through its mountings and against the latch mechanism to open the door.

SUMMARY OF THE INVENTION

According to the present invention, there is provided a lock assembly comprising a housing, a lock barrel movable axially and in rotation in the housing, a blocking plate mounted at the end of the housing and a finger extending axially from the end of the lock barrel. The cross-section of the finger and of an aperture in the blocking plate cooperate to allow the finger to pass through the blocking plate in one relative angular position so that the finger can release a latch and to prevent the finger from passing through in another relative angular position. The finger is adapted to shorten when an excessive axial load is applied between its ends.

With this assembly, if undue force is applied to the exposed end of the lock barrel when the lock is locked and axial movement of the barrel is blocked by the blocking plate, the finger will shorten, for example by crumpling or telescoping, rather than transmit the axial force to the blocking plate which might thereby be dislodged. Although the lock assembly will be damaged if this happens, the latch mechanism will not be released, and whatever is protected by the lock will be safe.

An excessive axial load means a load substantially greater than is needed to depress the lock barrel when the lock is unlocked, and a load that is greater than can be applied by a user's fingers, without mechanical assistance.

The finger is preferably formed in sections which are telescopic. There may be two or more sections. One of the sections may be adapted to crumple under excessive axially applied loads.

The locking plate is preferably held in the housing by a known mechanical fastener such as a circlip, and the lock barrel is preferably arranged so that, once the finger is relieved from load as a result of shortening of the finger, the lock barrel will bear, directly or indirectly, against an outer circumference of the blocking plate.

There is preferably a spring arranged between the lock barrel and the blocking plate, to return the barrel after it has been normally pushed in to release the latch mechanism. This spring may be a conically shaped or cylindrical helical spring.

BRIEF DESCRIPTION OF THE DRAWINGS

The invention will now be further described, by way of example, with reference to the accompanying drawing, in which.

DESCRIPTION OF THE PREFERRED EMBODIMENTS

Figure 1:
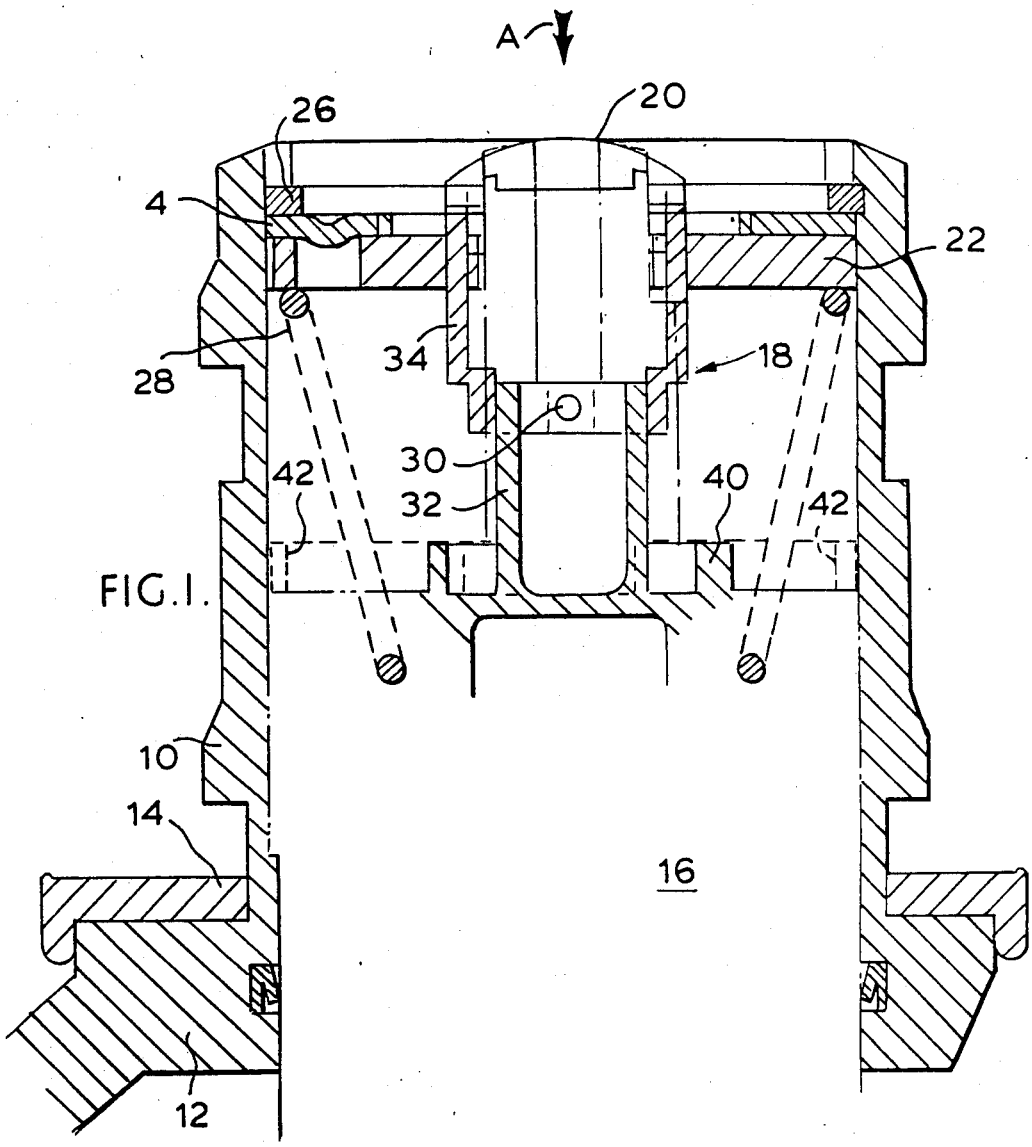
FIG. 1 is a section through a lock assembly in accordance with the invention.

The lock assembly shown in the figures has a housing 10 which is formed in one piece with an escutcheon plate 12. The escutcheon plate 12 fits on the outside of the vehicle body, and a gasket 14 seats the plate against the relevant body panel. A conventional fastener (not shown) is used to hold the housing in place.

Inside the housing 10 is a lock barrel 16 which, in a conventional manner, comprises a cylinder inside a sleeve. The sleeve is keyed to the inside wall of the housing, so that it can slide along the housing but cannot turn inside it, and the cylinder (which receives the key) can turn in the sleeve only when the correct key is inserted.

At the end of the barrel 16 there is an axially extending finger 18. This finger has a domed end 20, and passes through an aperture 24 in a blocking plate 22. The shape and cross-sections of the finger 18 and of the aperture 24 in the blocking plate 22 can be seen from FIGS. 2 and 3. The finger has a full height rib 35 with a reduced height shoulder 27 and a reduced height rib 29. In FIG. 3, the outline of the shaped aperture 24 in the blocking plate 22 is indicated in dotted lines.

The blocking plate 22 is held in the housing 10 by a circumferentially engaging fastener such as a circlip 26 and can be turned between a "locked" and an "unlocked" position in the housing. Turning is effected when the rib 35 acts against one or the other of the edges 31 and 33 of the aperture 24. The rib 35 always extends through the plate 22. A conical spring 28 acts between the lock barrel 16 and the blocking plate 22.

In operation, in the locked position, the lock barrel 16 cannot move axially because the blocking plate 22 blocks movement of the rib 29 and shoulder 27 of the finger 18 through the plate. The finger occupies the position shown in dotted lines in FIG. 2, where it cannot pass through the plate 22.

When the key is inserted, the lock cylinder is turned in the lock barrel 16 driving the plate 22 into the "unlocked" position. When the lock cylinder is returned to the neutral "key out" position, the outer end of the lock barrel 16 can then be pressed inwardly, against the pressure of the spring 28, and the domed end 20 of the finger 18 will then pass through the blocking plate 22 to press against a release plate of a latch mechanism to release the latch. When the barrel 16 is released, the spring 28 returns it to its normal position.

If, in the locked position, the outer end of the lock barrel 16 is hit with a hammer (this being a technique commonly used by car thieves to open a car door), a shear pin 30 which connects two sections 32 and 34 of the finger 18 will shear before the blocking plate 22 is dislodged or the end of the finger 18 breaks through the blocking plate 22. As a result, the section 32 will telescope inside the section 34, and the latch will not be released. The finger section 34 may be made so that it crumples if further impact is applied.

Once the shear pin 30 has sheared, the barrel 16 can move axially inside the housing 10, but the spring 28 will still act on the barrel 16. Further impacts will therefore largely be absorbed by the spring 28. However, when the spring 28 is fully compressed, axial loads applied to the barrel 16 will act, through the compressed spring 28, on the outer periphery of the plate 22, where this is directly supported by the circlip 26.

Alternatively or additionally, the outer sleeve of the barrel 16 may be extended in an axial direction, as indicated at 42 in FIG. 1, so that direct contact is achieved between the barrel 16 and the blocking plate 22, around the outer circumference of the blocking plate 22, if the barrel 16 should be driven right into the housing.

It will therefore be very much more difficult to dislodge the blocking plate 22 than would be the case if the axial loads which occur on an attempt to force the lock were applied at the center of the plate 22.

With the finger 18 constructed as shown in FIG. 1, there is a risk that the barrel 16 could become jammed in its pressed-in position if the shoulder at the lower end of the section 34 should engage with the outer surface of the plate 22, at the edges of the aperture 24 To prevent this, a shroud as indicated at 40 could be extended upward to cover the joint between the sections 32 and 34, and in this case, the diameter of the central circular part of the aperture 24 would have to be increased to allow the shroud 40 to pass through.

Where a central locking system is used, the blocking plate 22 may be rotatable by the central locking system (through a lug 23 forming part of the plate 22) to provide a different mechanism for freeing the barrel 16. When a central locking system is not used, a detent plate (not shown in detail) can be provided to prevent the blocking plate 22 from rattling and to retain the plate 22 in one or the other end position until a key is used to operate the lock.

Figure 4:
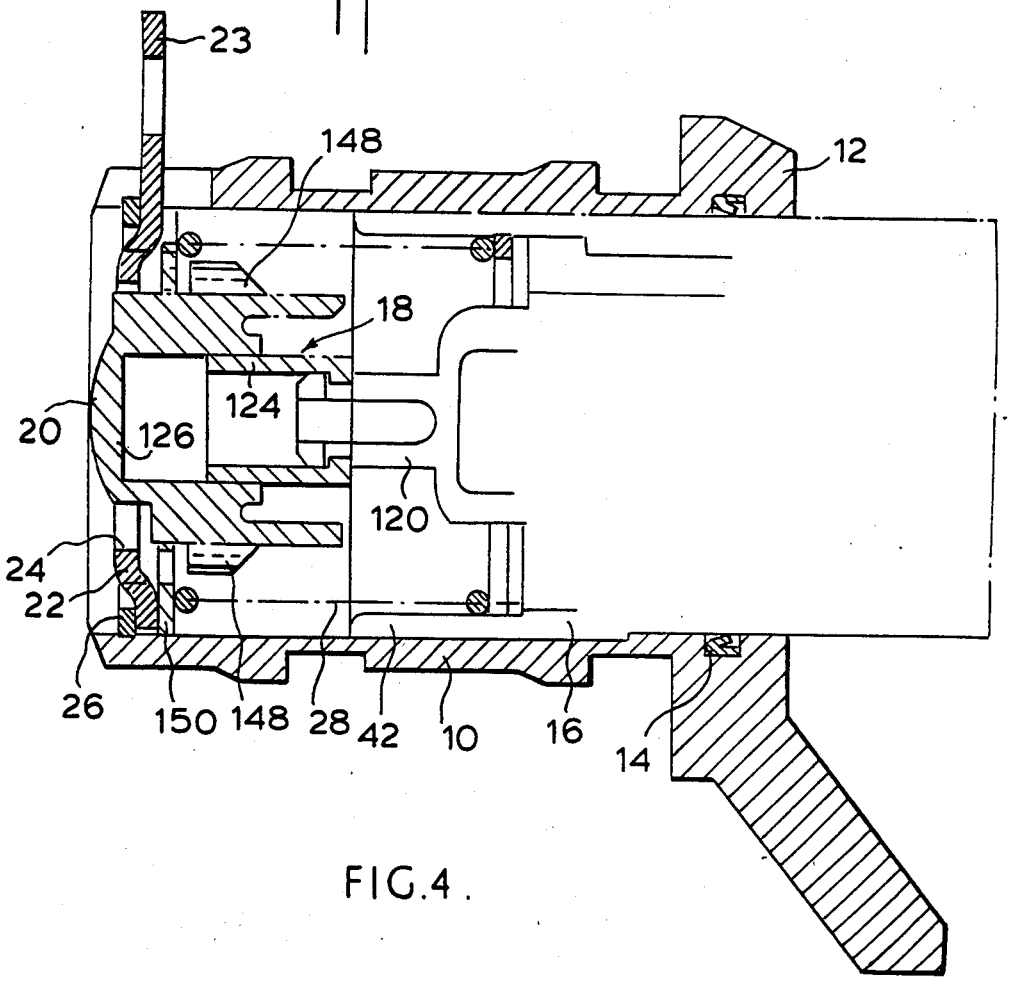
FIG. 4 is a section through a second embodiment of lock assembly in accordance with the invention.
Figure 5:
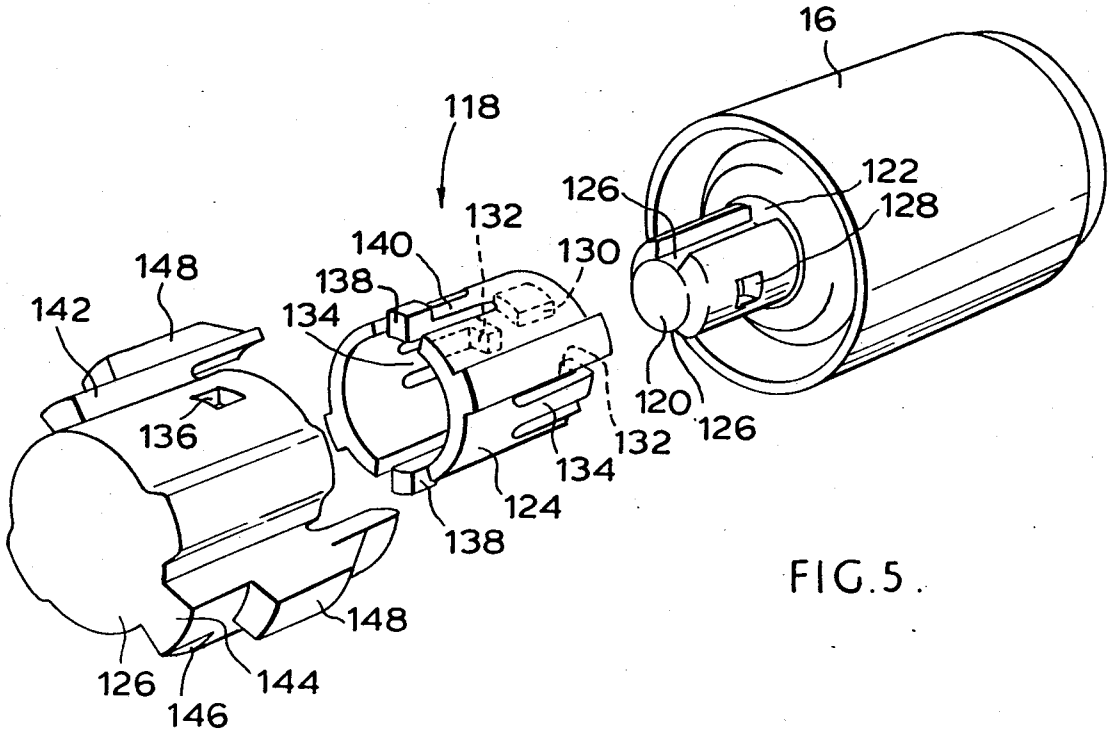
FIG. 5 is an exploded perspective view of the lock barrel shown in FIG. 4.

In FIGS. 4 and 5, parts equivalent to those already described are indicated using the same reference numerals. FIG. 4 shows a lock barrel 16 with a finger indicated generally at 118. As can be seen particularly in FIG. 5, the finger 118 consists of a first section 120 which is fast with the lock cylinder 122 inside the barrel and second and third sections 124 and 126 which are molded from plastic materials and which clip together and clip to the section 120.

The section 120 has oppositely arranged grooves 126 and recesses 128. The section 124 which fits over the section 126, has lugs 132 at the ends of arms 134, the lugs fitting in the recesses 128.

Similarly, the section 126 has internal recesses 136 and internal grooves which are not visible in the drawing. The section 126 fits over the section 124, lugs 138 on arms 140 fit in the recesses 136, and ribs 132 fit in the internal grooves.

Because of the engagement between the lugs 132 and 138 and the recesses 128 and 136, the three sections 120, 124 and 126 are normally held to each other in fixed relative positions. However, if an excessive axial force is applied along the finger 118, one or both sets of lugs 132, 138 will shear off from the ends of the respective arms 134, 140 to allow the sections to slide relative to one another, thus shortening the finger 118 and preventing release of a latch protected by the lock.

Figure 2:
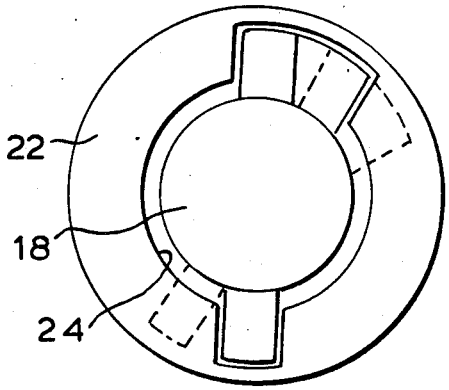
FIG. 2 is an end view in the direction of the arrow A of FIG. 1.
Figure 3:
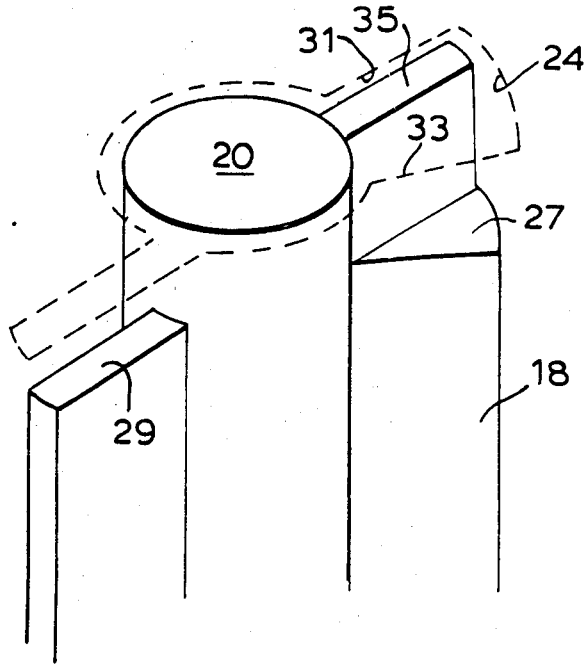
FIG. 3 is a perspective view of the end of the lock finger.

The section 126, similarly to the end 20 of the finger 18 in FIGS. 1 and 2, has a full height rib 144 with a reduced height shoulder 146 and a reduced height rib 142. Depending on the angular position of the aperture in the blocking plate, these ribs either prevent or allow the finger 118 to move through the plate.

In some locks, the cylinder can be turned in the locking direction by any key, but can only be turned in the unlocking direction by the correct key. To prevent the latch from being released while the key is in the lock and has been turned in the unlocking direction, a second, fixed blocking plate 150, as shown in FIG. 4, is provided which cooperates with outer ribs 148. The second blocking plate has a circular cut-out slightly larger in diameter than the diametral dimension across the ribs 142, 144, 146, as well as two radial passages which will pass the ribs 148. This ensures that there is only one angular position in which the latch can be unlocked.

To prevent the finger 118 being pressed too far through the blocking plate and possibly jamming, the outer ribs 148 are extended and tapered at their inner ends to ensure that the finger returns properly through the plates 22 and 150.

The lock assembly described will thus provide greater security than presently known locks of a similar type, particularly against attacks which involve hammering the lock barrel inwardly to release a latch.

What is claimed is:

1. A lock assembly comprising a housing, a lock barrel having portions movable axially and rotatively in the housing, a blocking plate having an aperture and mounted at an end of the housing and a finger extending axially from an end of the lock barrel toward the blocking plate, the cross-section of the finger and of the aperture in the blocking plate cooperating to allow the finger to pass through the blocking plate in one relative angular position so that the finger can release a latch and to prevent the finger from passing through in another relative angular position, characterized in that the finger includes means operative to permit the finger to shorten when said finger is rotated to said another angular position and an excessive axial load is applied to said barrel.

2. A lock assembly as defined in claim 1 wherein the barrel includes an outer casing which is extended in an axial direction so that as the barrel approaches the blocking plate, the first part of the barrel that makes contact with the blocking plate is the casing.

3. A lock assembly as defined in claim 1, including means for preventing the end of the finger from jamming behind the blocking plate.

4. A lock assembly as defined in claim 1, including a second, fixed blocking plate and a rib or ribs on the finger which will only pass the second blocking plate in one rotational position.

5. A lock assembly as defined in claim 1, including a spring arranged between the lock barrel and the blocking plate to return the barrel after it has been normally pushed in to release the latch.

6. A lock assembly as defined in claim 5 wherein the spring is a helical spring.

7. A lock assembly as defined in claim 1 wherein the finger is formed as a plurality of sections which are joined by an easily rupturable connection.

8. A lock assembly as defined in claim 7 wherein the rupturable connection is a shear pin.

9. A lock assembly as defined in claim 7 wherein the sections are formed of plastic material and the rupturable connection is made by shearable lugs which are molded as an integral part of the respective sections.

10. A lock assembly as defined in claim 7 wherein the sections of the finger telescopically engage one another.

11. A lock assembly as defined in claim 7, wherein the finger is formed as a plurality of sections, one of the sections being an extension of the barrel.

12. A lock assembly as defined in claim 11 wherein the rupturable connection is a shear pin.

13. A lock assembly as defined in claim 11 wherein the sections are formed of plastic material and the rupturable connection is made by shearable lugs which are molded as an integral part of the respective sections.

14. A lock assembly as defined in claims 1, 7, 11 or 9 wherein the blocking plate is held in the housing by a circumferentially engaging clip, and the lock barrel is arranged so that once the finger shortens and is relieved from load, the lock barrel will bear, directly or indirectly, against an outer circumference of the blocking plate.

* * * * *